US011702325B2

(12) United States Patent
Kanda et al.

(10) Patent No.: US 11,702,325 B2
(45) Date of Patent: Jul. 18, 2023

(54) METHOD FOR CONTROLLING CRANE, AND CRANE

(71) Applicant: TADANO LTD., Kagawa (JP)

(72) Inventors: Shinsuke Kanda, Kagawa (JP); Shoji Nishimoto, Kagawa (JP); Kazuma Mizuki, Kagawa (JP)

(73) Assignee: TADANO LTD., Kagawa (JP)

( * ) Notice: Subject to any disclaimer, the term of this patent is extended or adjusted under 35 U.S.C. 154(b) by 199 days.

(21) Appl. No.: 16/650,666

(22) PCT Filed: Oct. 3, 2018

(86) PCT No.: PCT/JP2018/037072
§ 371 (c)(1),
(2) Date: Mar. 25, 2020

(87) PCT Pub. No.: WO2019/069991
PCT Pub. Date: Apr. 11, 2019

(65) Prior Publication Data
US 2020/0247647 A1 Aug. 6, 2020

(30) Foreign Application Priority Data
Oct. 4, 2017 (JP) ..... 2017-194454

(51) Int. Cl.
*B66C 23/58* (2006.01)
*B66C 13/18* (2006.01)
(Continued)

(52) U.S. Cl.
CPC ..... *B66C 23/585* (2013.01); *B66C 13/18* (2013.01); *B66C 13/46* (2013.01); *B66C 23/42* (2013.01); *B66C 23/88* (2013.01)

(58) Field of Classification Search
CPC ..... B66C 23/585; B66C 13/16; B66C 13/18; B66C 13/46; B66C 23/42; B66C 23/88
See application file for complete search history.

(56) References Cited

U.S. PATENT DOCUMENTS 5,823,369 A * 10/1998 Kuromoto ..... B66C 23/84 212/273
2015/0249821 A1* 9/2015 Tanizumi ..... B66C 13/46 348/46
2016/0119589 A1* 4/2016 Tanizumi ..... B66C 13/16 345/173

FOREIGN PATENT DOCUMENTS

JP 2002-362880 A 12/2002
JP 2010-235249 A 10/2010

OTHER PUBLICATIONS

Translation of JP2010-235249, https://www.j-platpat.inpit.go.jp/ (Year: 2021).*

(Continued)

*Primary Examiner* — Sang K Kim
*Assistant Examiner* — Nathaniel L Adams
(74) *Attorney, Agent, or Firm* — Paratus Law Group, PLLC

(57) ABSTRACT

There is provided a method for controlling a crane, with which the position of a hook is automatically adjusted before lift-off, where a freely-derricking telescopic boom is provided to a swivel base, a main hook is suspended with a main wire rope from a distal end section of the telescopic boom, and a suspended load is suspended on a main hook with slinging wire ropes, wherein post-slinging lift-off is preceded by a hook position adjustment control involving repeating: a first process where the control device controls so as to reel in the main wire rope to a position where the main wire rope is tensed; and a second process where the control device controls so as to move the distal end section of the telescopic boom in the same direction of a horizontal direction component of the movement of the main hook in the first process.

7 Claims, 15 Drawing Sheets

(51) Int. Cl.

| | |
|---|---|
| ***B66C 23/42*** | (2006.01) |
| ***B66C 23/88*** | (2006.01) |
| ***B66C 13/46*** | (2006.01) |

(56) References Cited

OTHER PUBLICATIONS

Mar. 26, 2021, European Search Report issued for related EP Application No. 20210511.0.
Dec. 18, 2018, International Search Report issued for related PCT Application No. PCT/JP2018/037072.
Dec. 18, 2018, International Search Opinion issued for related PCT Application No. PCT/JP2018/037072.

* cited by examiner

METHOD FOR CONTROLLING CRANE, AND CRANE

CROSS REFERENCE TO PRIOR APPLICATION

This application is a National Stage Patent Application of PCT International Patent Application No. PCT/JP2018/037072 (filed on Oct. 3, 2018) under 35 U.S.C. § 371, which claims priority to Japanese Patent Application No. 2017-194454 (filed on Oct. 4, 2017), which are all hereby incorporated by reference in their entirety.

TECHNICAL FIELD

The present invention relates to a crane, and more particularly to a control for the crane performed before lift-off of a load.

BACKGROUND ART

When a crane performs lift-off that is to lift a load off the ground, the load has to be lifted vertically with respect to its center-of-gravity position in order to reduce occurrences of side pulling and/or a swing of the load. For example, Patent Literature (hereinafter, referred to as "PTL") 1 discloses a control method in which a winch is operated for winding up until a wire rope and a hoisting instrument are tensioned so as not to loosen, and then the boom is operated for lift-off.

According to this control method, the load is automatically lifted off the ground vertically upward when an operator manipulates a manipulation means after adjusting a hook to a position vertically below the leading end of a telescopic boom.

CITATION LIST

Patent Literature

PTL 1

Japanese Patent Application Laid-Open No. 2002-362880

SUMMARY OF INVENTION

Technical Problem

However, in PTL 1, the operator is required to manually move the telescopic boom such that the leading end of the telescopic boom is positioned on a vertical line passing through the center of gravity of the load in preparation for lift-off. Such manipulation before the lift-off depends on the skill of the operator. In addition, when the load is situated at a position where the operator cannot see it, the operator needs to manipulate according to instructions of another operator near the load and is required to be further skilled. As is understood, adjusting the position of the hook before the lift-off has been an onerous task for the operator.

The present invention aims to provide a control method for a crane which adjusts the position of a hook automatically before lift-off. The present invention also aims to provide the crane which adjusts the position of the hook automatically before lift-off.

Solution to Problem

A control method for a crane in which a telescopic boom capable of luffing, extending, and retracting is disposed on a swivel base, a hook is suspended by a wire rope from a leading end of the telescopic boom or from a leading end of a jib disposed on the telescopic boom, and a load is suspended on the hook by a plurality of sling wire ropes, the control method including: a hook position adjustment control in which, before lift-off after slinging, a control device repeats a first process and a second process, the first process being a control to pull in the wire rope to a position where the wire rope is tensioned, the second process being a control to move the leading end of the telescopic boom in a same direction as a horizontal component of movement of the hook moved in the first process.

In the above control method, the second process may include a control to end the hook position adjustment control when the horizontal component of movement of the hook is less than a first movement amount.

Additionally or alternatively, in the above control method, the second process may include a control to end the hook position adjustment control when a movement amount of the hook is less than a second movement amount.

Additionally or alternatively, in the above control method, the second process may include a control to end the hook position adjustment control when the plurality of sling wire ropes are not deflected.

Additionally or alternatively, in the above control method, the second process may include a control to pull in the wire rope to the position where the wire rope is tensioned, then let out the wire rope to a position where the wire rope is relaxed, and end the hook position adjustment control when a horizontal movement amount of the hook moved in the control to let out the wire rope is less than a third movement amount.

A crane includes: a swivel base; a telescopic boom disposed on the swivel base so as to be capable of luffing, extending, and retracting; a wire rope to be pulled in or let out from a leading end of the telescopic boom or a leading end of a jib disposed on the telescopic boom; a hook suspended by the wire rope; and a control device that performs a hook position adjustment control in which, before a load suspended on the hook by a plurality of sling wire ropes is lifted off, a first process and a second process are repeated, the first process being a control to pull in the wire rope to a position where the wire rope is tensioned, the second process being a control to move the leading end of the telescopic boom in a same direction as a horizontal component of movement of the hook moved in the first process.

In the above crane, the second process may include a control to end the hook position adjustment control when the horizontal component of movement of the hook is less than a first movement amount.

Additionally or alternatively, in the above crane, the second process may include a control to end the hook position adjustment control when a movement amount of the hook is less than a second movement amount.

Additionally or alternatively, in the above crane, the second process may include a control to end the hook position adjustment control when the plurality of sling wire ropes are not deflected.

Additionally or alternatively, in the above crane, the second process may include a control to pull in the wire rope to the position where the wire rope is tensioned, then let out the wire rope to a position where the wire rope is relaxed, and end the hook position adjustment control when a horizontal movement amount of the hook moved in the control to let out the wire rope is less than a third movement amount.

Advantageous Effects of Invention

According to the present invention, the hook position adjustment control is performed before lift-off after slinging, so that it is possible to automatically adjust the position of the hook such that all sling wire ropes are substantially tensioned at the time of lift-off. It is thus possible to lift the load substantially vertically with respect to its center-of-gravity position at the time of lift-off, so as to reduce the occurrences of side pulling and/or a swing of the load. Moreover, the operator does not need to manually adjust the position of the hook and/or the tension of the sling wire ropes before lift-off while checking the position of the hook and/or the tension of the sling wire ropes, so that it is possible to reduce the load on the operator.

DESCRIPTION OF EMBODIMENTS

The present embodiment will be described with respect to a mobile crane as an example of a crane. Note that the crane may be any crane as long as it includes a telescopic boom luffed or extended or retracted by an actuator, a swivel base, and one or more winches.

<Outline of Crane>

Figure 1:
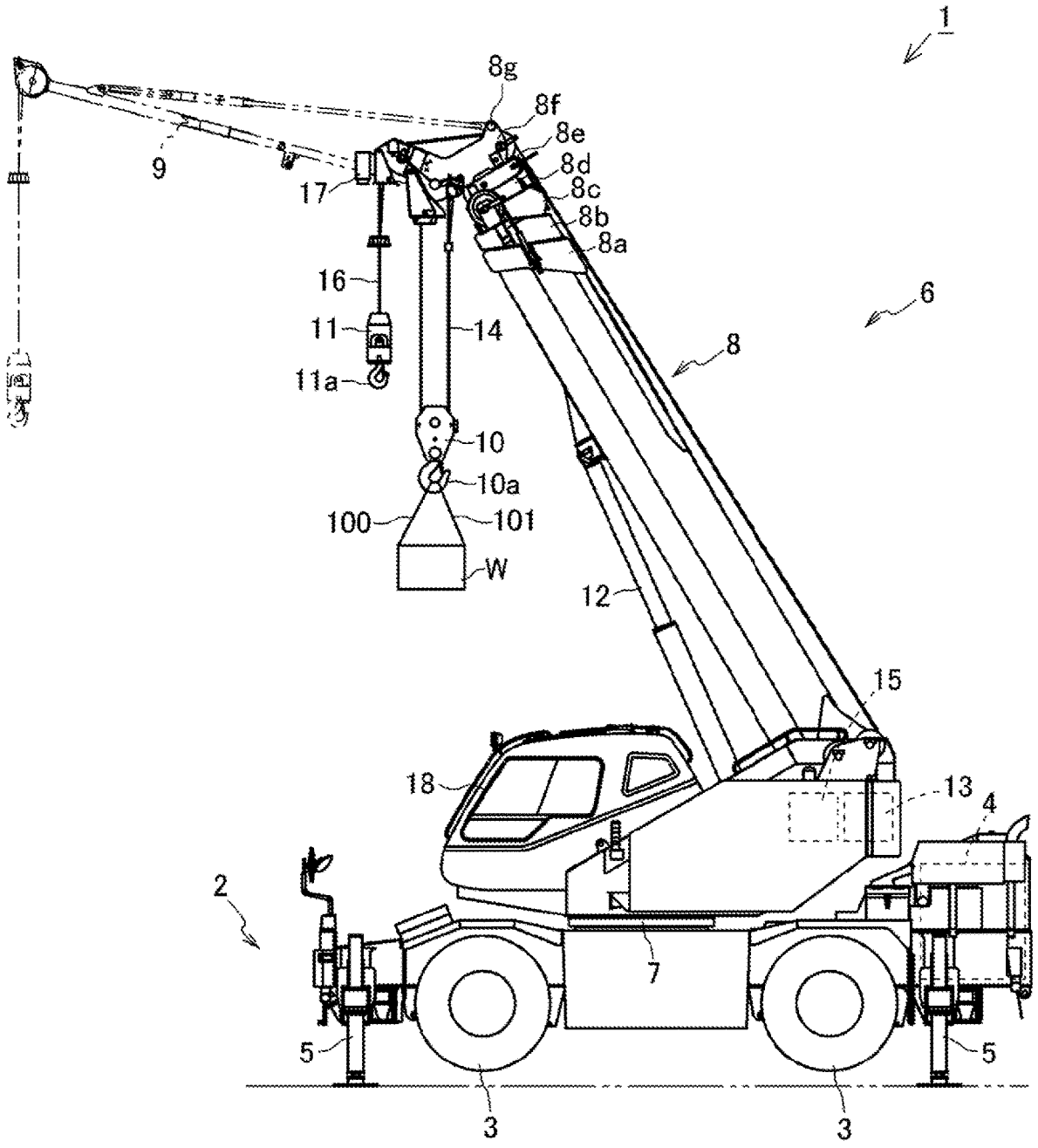
FIG. 1 is a side view of a crane according to one embodiment.

As illustrated in FIG. 1, crane 1 is a mobile crane that can be moved to an unspecified place. Crane 1 includes vehicle 2 and crane device 6.

Vehicle 2 carries crane device 6. Vehicle 2 includes a plurality of wheels 3, and travels using engine 4 as a power source. Vehicle 2 is provided with outriggers 5. Outriggers 5 are composed of projecting beams hydraulically extendable on both sides of vehicle 2 in the width direction and hydraulic jack cylinders extendable in the direction vertical to the ground. Vehicle 2 can extend a workable region of crane 1 by extending outriggers 5 in the width direction of vehicle 2 and bringing the jack cylinders into contact with the ground.

Crane device 6 lifts load (carried object) W with a wire rope. Crane device 6 includes swivel base 7, telescopic boom 8, jib 9, main hook block 10, sub hook block 11, luffing cylinder 12, main winch 13, main wire rope 14, sub winch 15, sub wire rope 16, camera 17, cabin 18, and the like.

Swivel base 7 allows crane device 6 to swivel. Swivel base 7 is disposed on a frame of vehicle 2 via an annular bearing. The annular bearing is disposed such that its rotational center is vertical to the installation surface of vehicle 2. Swivel base 7 is configured to be rotatable in one and the other directions around the center of the annular bearing serving as a rotational center. In addition, swivel base 7 is rotated by hydraulic swivel motor 19 (see FIG. 2). Swivel base 7 is provided with swivel position detection sensor 21 (see FIG. 2) that detects the swivel position of swivel base 7.

Telescopic boom 8 supports the wire rope such that load W can be lifted. Telescopic boom 8 is composed of a plurality of boom members, that is, base boom member 8*a*, second boom member 8*b*, third boom member 8*c*, fourth boom member 8*d*, fifth boom member 8*e*, and top boom member 8*f* The boom members are inserted in a telescopic manner in order of the size of sectional surfaces. Telescopic boom 8 is configured to be extendible and retractable in the axial direction by moving the boom members by using telescopic cylinder 29 (see FIG. 2). Telescopic boom 8 is, at the base end of base boom member 8*a*, swingably provided on swivel base 7. Telescopic boom 8 is thus configured to be horizontally rotatable and swingable on the frame of vehicle 2. Telescopic boom 8 is provided with telescopic-boom-length detection sensor 22 that detects the telescopic boom length, and luffing-angle detection sensor 23 (see FIG. 2) that detects the luffing angle.

Jib 9 extends the lifting height and the operating radius of crane device 6. Jib 9 is held by jib supporting part 8*g* disposed in top boom member 8*f* of telescopic boom 8 such that the attitude of jib 9 is along top boom member 8*f*. The base end of jib 9 is configured to be able to be coupled to jib supporting part 8*g* of top boom member 8*f*.

Main hook block 10 is for suspending load W. Main hook block 10 is provided with a plurality of hook sheaves around which main wire rope 14 is wound, and main hook 10*a* for suspending load W. Sub hook block 11 is for suspending load W. Sub hook block 11 is provided with sub hook 11*a* for suspending load W.

Luffing cylinder 12 luffs up or down telescopic boom 8, and holds the attitude of telescopic boom 8. Luffing cylinder 12 includes a hydraulic cylinder made up of a cylinder part and a rod part. In luffing cylinder 12, an end of the cylinder part is swingably coupled to swivel base 7, and an end of the rod part is swingably coupled to base boom member 8*a* of telescopic boom 8. Luffing cylinder 12 has a configuration in which operating oil is supplied so as to push the rod part out of the cylinder part, so that base boom member 8*a* is luffed up, or the operating oil is supplied so as to push the rod part back into the cylinder part, so that base boom member 8*a* is luffed down.

Main winch 13 pulls in (winds up) or lets out (winds out) main wire rope 14. Main winch 13 has a configuration in which a main drum around which main wire rope 14 is wound is rotated by a main hydraulic motor. Main winch 13 has a configuration in which the operating oil is supplied so as to rotate the main hydraulic motor in one direction, so that main wire rope 14 wound around the main drum is let out, or the operating oil is supplied so as to rotate the main hydraulic motor in the other direction, so that main wire rope 14 is pulled in around the main drum. Main winch 13 is provided with main-drum revolution detector 24 (see FIG. 2) for detecting the revolution of main winch 13 and main-wire tension detector 25 (see FIG. 2) for detecting the tension of main wire rope 14.

Sub winch 15 pulls in or lets out sub wire rope 16. Sub winch 15 has a configuration in which a sub drum around which sub wire rope 16 is wound is rotated by a sub hydraulic motor. Sub winch 15 has a configuration in which the operating oil is supplied so as to rotate the sub hydraulic motor in one direction, so that sub wire rope 16 wound around the sub drum is let out, or the operating oil is supplied so as to rotate the sub hydraulic motor in the other direction, so that sub wire rope 16 is pulled in around the sub drum. Sub winch 15 is provided with sub-drum revolution detector 26 (see FIG. 2) for detecting the revolution of sub winch 15 and sub-wire tension detector 27 (see FIG. 2) for detecting the tension of sub wire rope 16.

Camera 17 captures an image of load W and its surroundings. In FIG. 1, load W is suspended on main hook 10*a*, in which case camera 17 captures an image of main wire rope 14, main hook 10*a*, sling wire ropes 100 and 101, and load W. Camera 17 is provided on the leading end of top boom member 8*f* of telescopic boom 8 or on the leading end of jib 9. Camera 17 is disposed on top boom member 8*f* via an actuator for changing the attitude of camera 17. Camera 17 is configured to be swingable about an axis parallel to the swing axis of telescopic boom 8 which serves as the swing center. Accordingly, camera 17 is configured to be capable of capturing an image in a vertically-downward direction from its installation position regardless of the luffing angle of telescopic boom 8 or the luffing angle of jib 9.

Cabin 18 covers an operator compartment. Cabin 18 is provided on swivel base 7 on a lateral side of telescopic boom 8. The operator compartment is provided inside cabin 18. The operator compartment is provided with a main manipulation tool for manipulating main winch 13, a sub manipulation tool for manipulating sub winch 15, an extension/retraction manipulation tool for manipulating telescopic boom 8, a steering for moving crane 1, hook position adjustment control switch 28 (see FIG. 2) for performing a hook position adjustment control, and the like.

Crane 1 configured as described above is capable of moving crane device 6 to any position by causing vehicle 2 to travel. In addition, crane 1 is capable of extending the lifting height and/or the operating radius of crane device 6 by luffing up telescopic boom 8 to any luffing angle with luffing cylinder 12, extending telescopic boom 8 to any telescopic boom length, and/or coupling jib 9 to telescopic boom 8.

<Configuration of Control System Related to Hook Position Adjustment Control>

Figure 2:
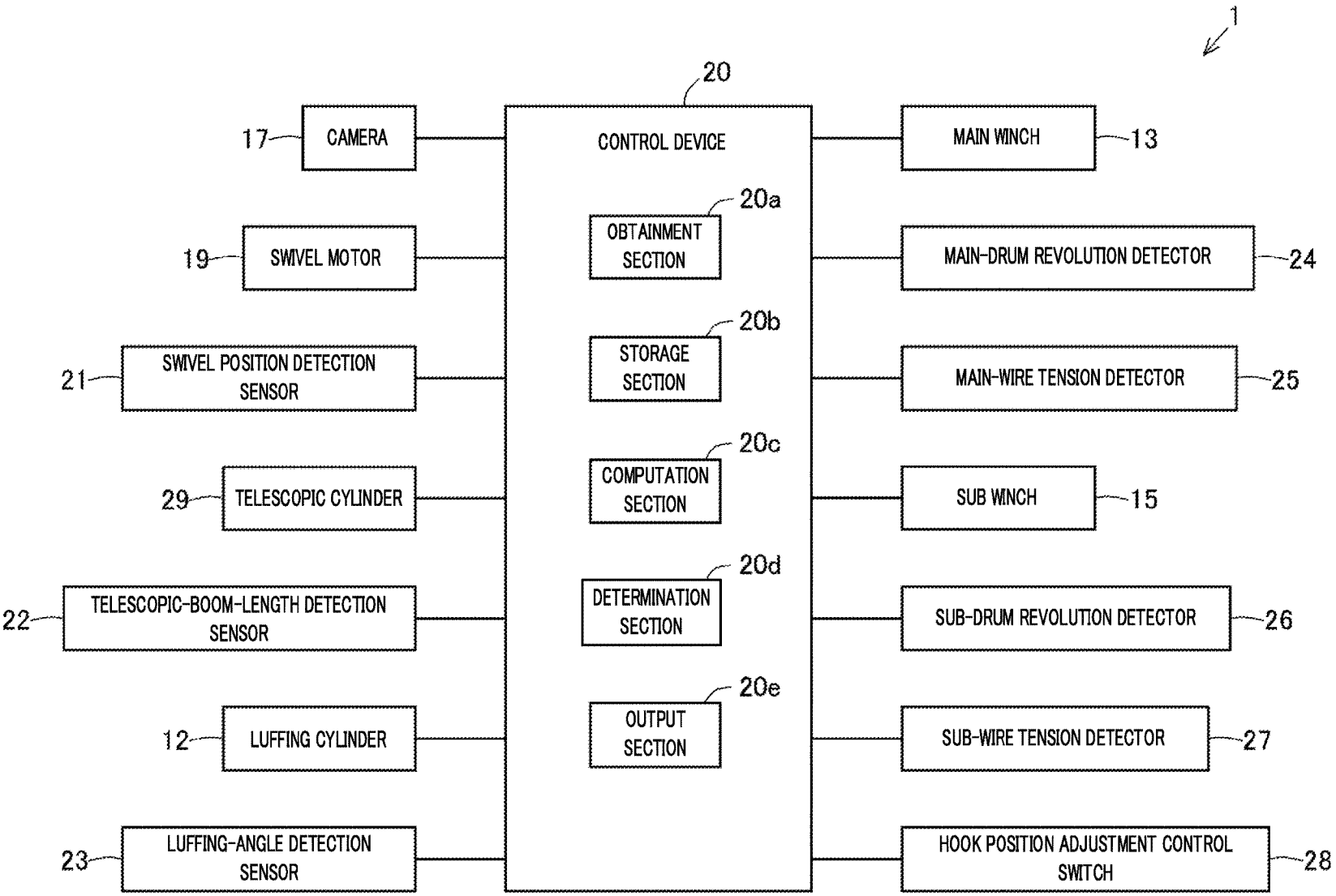
FIG. 2 illustrates a configuration of a control system related to a hook position adjustment control according to one embodiment.

FIG. 2 illustrates a configuration of a control system related to the hook position adjustment control. Crane 1 is provided with control device 20, for example, inside cabin 18. Control device 20 is connected to camera 17, swivel motor 19, swivel position detection sensor 21, telescopic cylinder 29, telescopic-boom-length detection sensor 22, luffing cylinder 12, luffing-angle detection sensor 23, main winch 13, main-drum revolution detector 24, main-wire tension detector 25, sub winch 15, sub-drum revolution detector 26, sub-wire tension detector 27, and hook position adjustment control switch 28. Wireless or wired connection can be used for connection between control device 20 and each component.

Control device 20 controls a swivel operation, an extension/retraction operation, and a luffing operation of telescopic boom 8; a raising/lowering operation of main hook block 10 and sub hook block 11; and other various operations. Control device 20 also performs the hook position adjustment control of automatically adjusting main hook 10*a* or sub hook 11*a* to an optimum position before lift-off after slinging in order to reduce the occurrences of side pulling and/or a swing of load W. Control device 20 may have a configuration in which a CPU, ROM, RAM, HDD, and/or the like are connected to one another via a bus, or may also be configured to consist of a one-chip LSI or the like. Control device 20 stores therein a variety of programs and data for performing the hook position adjustment control.

Control device 20 is provided with obtainment section 20*a*, storage section 20*b*, computation section 20*c*, determination section 20*d*, and output section 20*e*.

Obtainment section 20*a* obtains information on each component connected to control device 20. Obtainment section 20*a* obtains an image captured by camera 17. In the present embodiment, obtainment section 20*a* always obtains images captured by camera 17 at predetermined intervals. Obtainment section 20*a* also obtains detection values of swivel position detection sensor 21, telescopic-boom-length detection sensor 22, luffing-angle detection sensor 23, main-drum revolution detector 24, main-wire tension detector 25, sub-drum revolution detector 26, and sub-wire tension detector 27. Obtainment section 20*a* also obtains a manipulation signal from hook position adjustment control switch 28.

Storage section 20*b* stores therein information used for the hook position adjustment control; that is, storage section 20*b* stores therein the information obtained by obtainment section 20*a*, information computed by computation section 20*c*, a predetermined movement amount used by determination section 20*d*, and a result determined by determination section 20*d*. Storage section 20*b* also stores therein a program for performing the hook position adjustment control.

Computation section 20*c* performs a computation required for the hook position adjustment control based on the information obtained by obtainment section 20*a*. For example, in a case where load W is suspended on main hook 10*a*, computation section 20*c* analyzes the image captured by camera 17 and computes the movement direction and movement amount of main hook 10*a*. Computation section 20*c* also computes the pulled-in amount or the let-out amount of main wire rope 14 from revolutions of main winch 13 detected by main-drum revolution detector 24.

Determination section 20*d* performs a determination required for the hook position adjustment control based on the information obtained by obtainment section 20*a*, the predetermined movement amount stored in storage section 20*b*, and the computation result of computation section 20*c*. For example, in a case where load W is suspended on main hook 10*a*, determination section 20*d* determines whether or not main hook 10*a* is moved when main wire rope 14 is pulled in.

Determination section 20*d* also determines whether main wire rope 14 is in a tensioned or relaxed state based on the tension of main wire rope 14 detected by main-wire tension detector 25. Determination section 20*d* also determines whether main wire rope 14 becomes relaxed or not, that is, whether main wire rope 14 is changed from the tensioned state to the relaxed state when the leading end of telescopic boom 8 is moved. The tensioned state can be determined when the tension detected by main-wire tension detector 25 is greater than or equal to a predetermined value, and the relaxed state can be determined when the tension is less than the predetermined value. Determination section 20*d* also determines based on the image captured by camera 17 whether or not sling wire ropes 100 and 101 are deflected.

In the present embodiment, the tensioned state refers to a state in which main wire rope 14 is apparently in a linear state and is stretched owing to the elasticity of main wire rope 14. Meanwhile, the relaxed state includes a state in which main wire rope 14 is apparently deflected and a state in which main wire rope 14 is in a linear state and is not stretched.

Output section 20*e* outputs a signal for operating swivel motor 19, telescopic cylinder 29, luffing cylinder 12, main winch 13, and sub winch 15 based on the instructions from obtainment section 20*a*, computation section 20*c*, and determination section 20*d*.

<Hook Position Adjustment Control>

The hook position adjustment control is a control of automatically adjusting main hook 10*a* to an optimum position before lift-off after slinging in order to reduce the occurrences of side pulling and/or a swing of load W. Hereinafter, the hook position adjustment control will be described with respect to four embodiments as examples. By way of an example, each embodiment will be described in which load W is suspended on main hook 10*a* by two-point suspension by using two-legged sling wire ropes 100 and 101. Sling wire ropes 100 and 101 are disposed so as not to be deflected in a state where main hook 10*a* is disposed on a vertical line passing through the center of gravity of load W.

Embodiment 1

Figure 3:
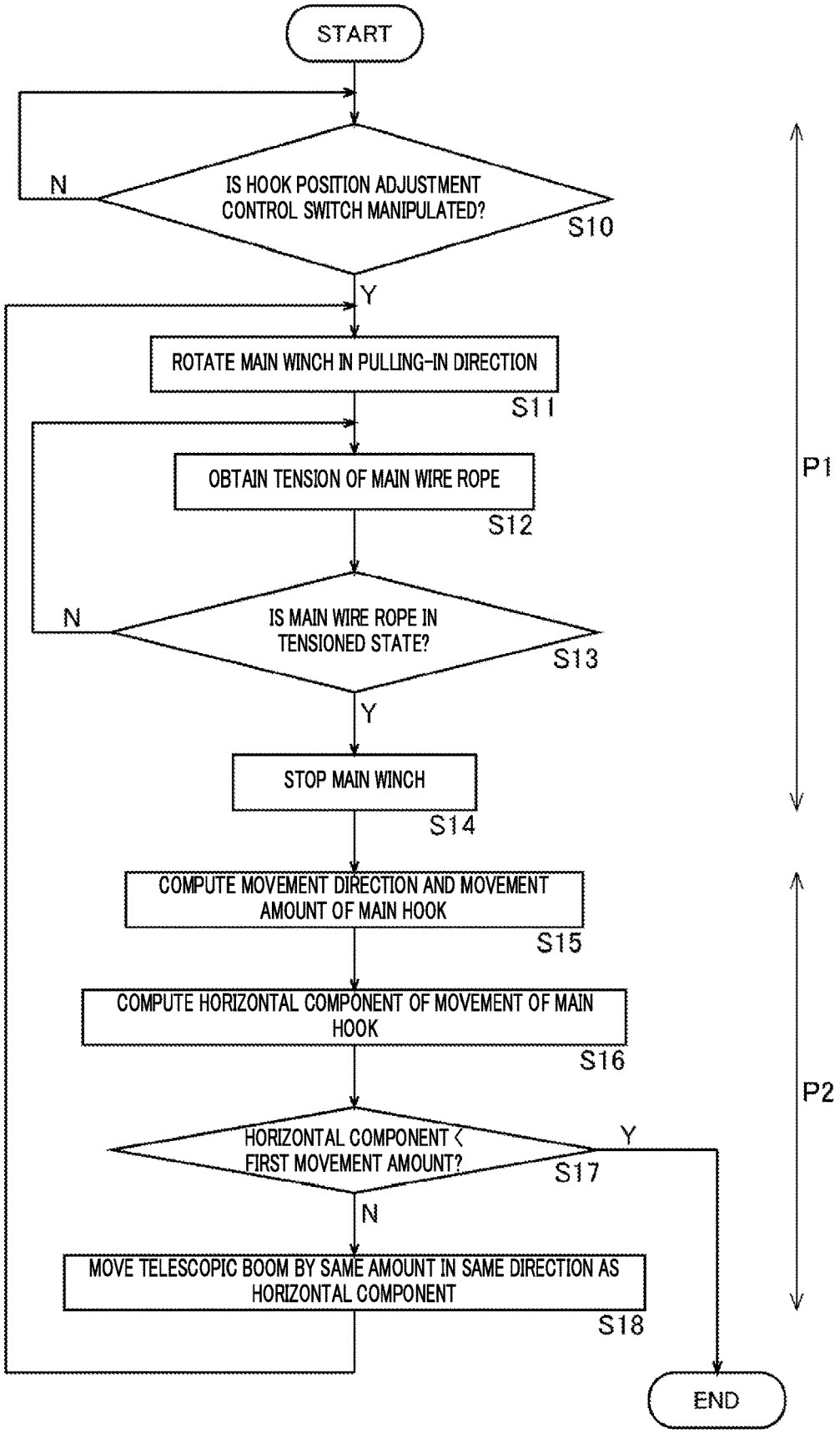
FIG. 3 is a flowchart illustrating an operation of the crane related to the hook position adjustment control according to Embodiment 1.

FIG. 3 is a flowchart illustrating the operation of crane 1 related to the hook position adjustment control according to Embodiment 1.

To begin with, at step S10, control device 20 stands by until obtainment section 20*a* obtains a manipulation signal from hook position adjustment control switch 28. When hook position adjustment control switch 28 is manipulated by an operator, obtainment section 20*a* obtains the manipulation signal from hook position adjustment control switch 28 at step S10. Accordingly, control device 20 determines that an instruction to perform the hook position adjustment control has been received, and proceeds to step S11 to perform the hook position adjustment control.

Note that, control device 20 may proceed from step S10 to step S11 after confirming that load W is in a state before lift-off after slinging in order that an erroneous manipulation of hook position adjustment control switch 28 should not cause the hook position adjustment control to be performed. For example, when obtainment section 20*a* obtains the manipulation signal from hook position adjustment control switch 28, determination section 20*d* determines based on the image captured by camera 17 whether or not load W is in the state before lift-off after slinging. Then, when it is determined that load W is in the state before lift-off after slinging, control device 20 proceeds to step S11. Meanwhile, when it is determined that load W is not in the state before lift-off after slinging, control device 20 does not proceed to step S11, and outputs from output section 20*e* to a display section (not illustrated) an indication that the manipulation of hook position adjustment control switch 28 is invalid.

At step S11, output section 20*e* outputs to main winch 13 a signal for rotation in a pulling-in direction. Main wire rope 14 is thus pulled in. Subsequently, control device 20 proceeds to step S12 at which obtainment section 20*a* obtains a detection value from main-wire tension detector 25. Then, control device 20 proceeds to step S13 at which determination section 20*d* determines whether main wire rope 14 is in the tensioned or relaxed state.

When main wire rope 14 is determined to be in the relaxed state at step S13, control device 20 returns to step S12. Then, when at least one of sling wire ropes 100 and 101 is changed from the relaxed state to the tensioned state so that main wire rope 14 is changed from the relaxed state to the tensioned state at step S13, control device 20 proceeds from step S13 to step S14 at which output section 20*e* outputs a signal to stop revolution to main winch 13. Main winch 13 is thus stopped.

When the operations of from step S11 to step S14 are collectively referred to as first process P1, first process P1 may be said to be a control by control device 20 to pull in main wire rope 14 to a position where main wire rope 14 is tensioned.

Control device 20 proceeds from step S14 to step S15 at which computation section 20*c* analyzes the image captured by camera 17, and computes movement direction and movement amount V1 (see FIG. 5) of main hook 10*a* moved in first process P1. Subsequently, control device 20 proceeds to step S16 at which computation section 20*c* computes horizontal component V2 (see FIG. 5) from movement direction and movement amount V1 of main hook 10*a*.

Figure 5:
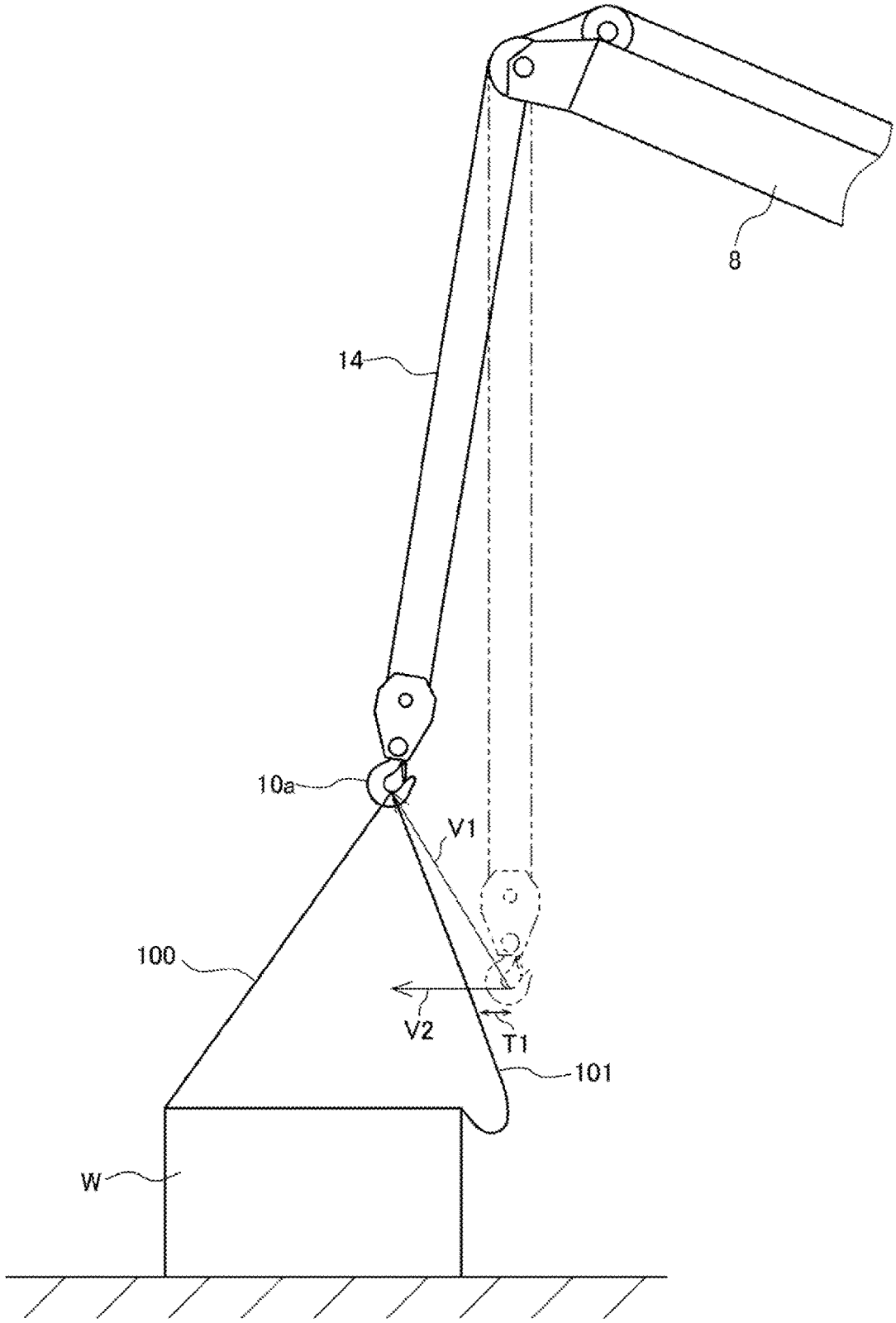
FIG. 5 illustrates the operation of the crane following that of FIG. 4.

Control device 20 proceeds from step S16 to step S17 at which determination section 20*d* determines whether or not horizontal component V2 computed at step S16 is less than first movement amount T1 (see FIG. 5). When it is determined at step S17 that horizontal component V2 is less than first movement amount T1, control device 20 ends the hook position adjustment control.

First movement amount T1 may be a value corresponding to little movement of main hook 10*a* in first process P1. This indicates that main hook 10*a* is located at a position where all sling wire ropes 100 and 101 are substantially in the tensioned state. It is possible to bring main hook 10*a* closer to a more appropriate position by setting smaller first movement amount T1.

On the other hand, when it is determined at step S17 that horizontal component V2 is greater than or equal to first movement amount T1, control device 20 proceeds to step S18 at which output section 20*e* outputs, to any necessary component among swivel motor 19, telescopic cylinder 29, and luffing cylinder 12, a signal for moving the leading end of telescopic boom 8 by the same amount in the same direction as horizontal component V2 computed at step S16.

Note that, the movement amount of the leading end of telescopic boom 8 at step S18 does not have to be the same as horizontal component V2 of the movement amount of main hook 10*a* computed at step S16, and may be smaller or greater than horizontal component V2 as long as the movement amount of the leading end of telescopic boom 8 is in the same direction as horizontal component V2.

When the operations of from step S15 to step S18 are collectively referred to as second process P2, second process P2 may be said to be a control by control device 20 to move the leading end of telescopic boom 8 in the same direction as horizontal component V2 of movement of main hook 10*a* in first process P1.

Returning to step S11 from step S18, control device 20 repeats first process P1 and second process P2 until the horizontal component of movement of main hook 10*a* is determined to be less than the first moving amount at step S17.

Performance of the hook position adjustment control before lift-off after slinging thus makes it possible to automatically adjust the position of main hook 10*a* such that all sling wire ropes 100 and 101 are substantially brought into the tensioned state on the occasion of lift-off. Accordingly, it is possible to lift load W substantially vertically with respect to its center of gravity position on the occasion of lift-off so as to reduce occurrences of side pulling and/or a swing of load W. Moreover, the operator does not need to manually adjust the position of main hook 10*a* and/or the tension of sling wire ropes 100 and 101 before lift-off while checking the position of main hook 10*a* and/or the tension of sling wire ropes 100 and 101, so that it is possible to reduce the load on the operator.

Figure 4:
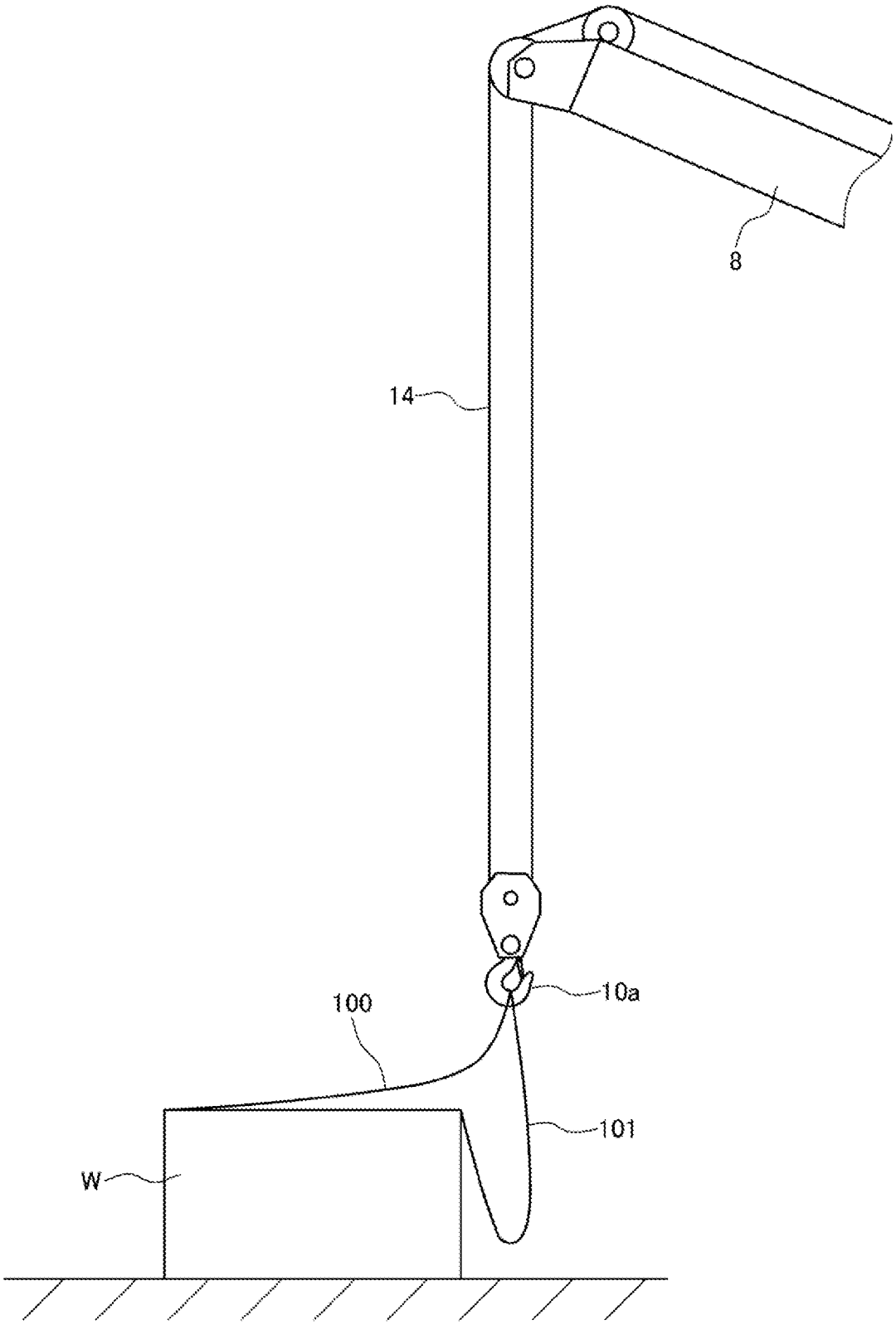
FIG. 4 illustrates the operation of the crane according to one example of Embodiment 1.

Next, a description will be given of one example of Embodiment 1 with reference to FIGS. 4 to 10. FIG. 4 illustrates the state before lift-off after slinging, in which load W is slung from main hook 10*a* by sling wire ropes 100 and 101. In this state, main hook 10*a* is located at a position distant from the center of gravity of load W, and sling wire ropes 100 and 101 are in the relaxed state.

When hook position adjustment control switch 28 is manipulated by the operator in the state of FIG. 4, crane 1 rotates main winch 13 in the pulling-in direction to pull in main wire rope 14. As illustrated in FIG. 5, when main wire rope 14 comes to be in the tensioned state, main winch 13 is stopped. At this time, sling wire rope 100 is in the tensioned state and sling wire rope 101 remains in the relaxed state.

Figure 6:
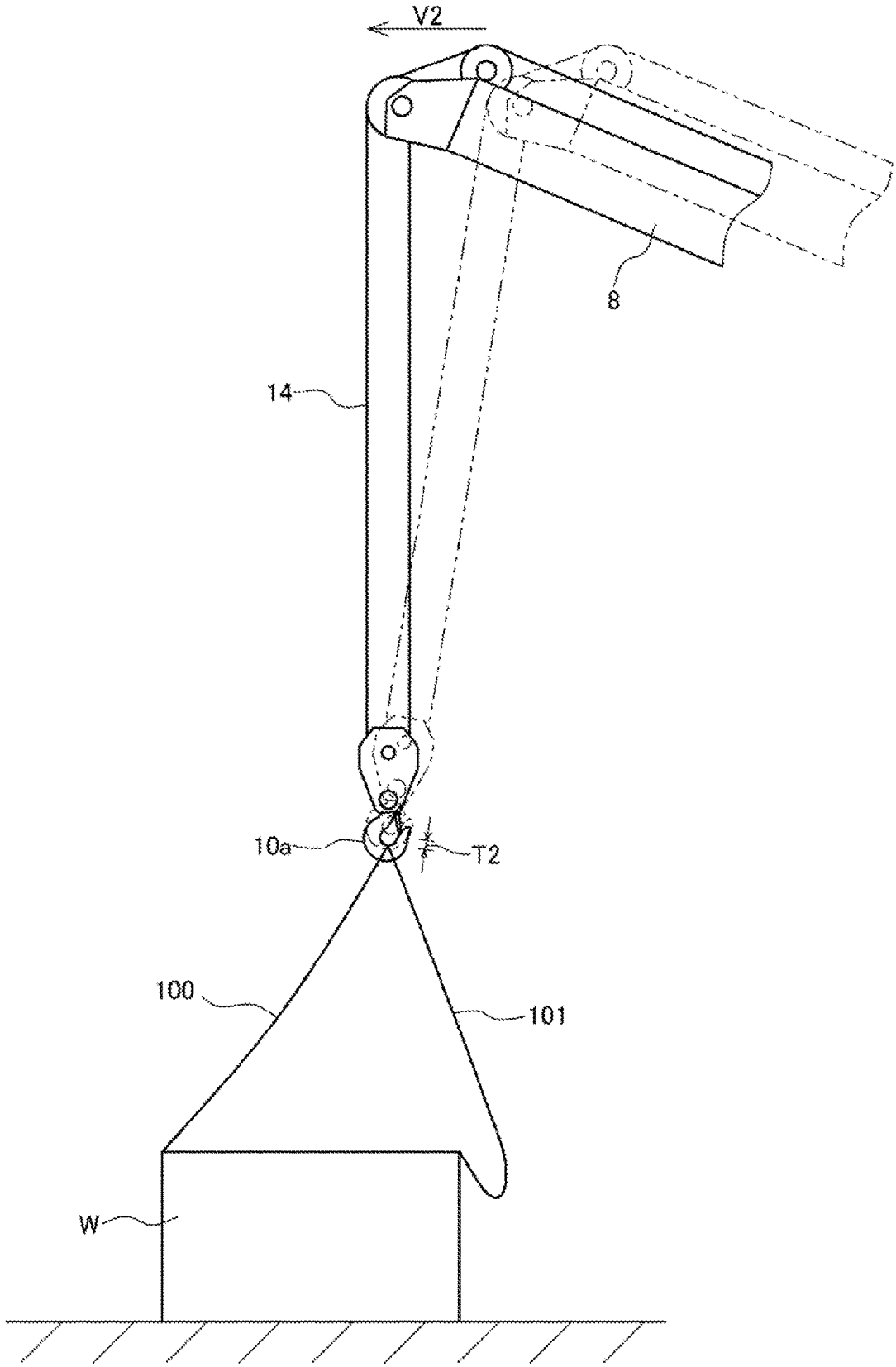
FIG. 6 illustrates the operation of the crane following that of FIG. 5.

Next, crane 1 computes movement direction and movement amount V1 of main hook 10*a* moved during transition of from the state of FIG. 4 to the state of FIG. 5, and computes horizontal component V2 of movement direction and movement amount V1. Then, after determining that horizontal component V2 is greater than or equal to first movement amount T1, crane 1 moves the leading end of telescopic boom 8 by the same amount in the same direction as horizontal component V2 as illustrated in FIG. 6. Accordingly, main hook 10*a* is lowered, sling wire rope 100 is relaxed, and main wire rope 14 is bought into the relaxed state.

Figure 7:
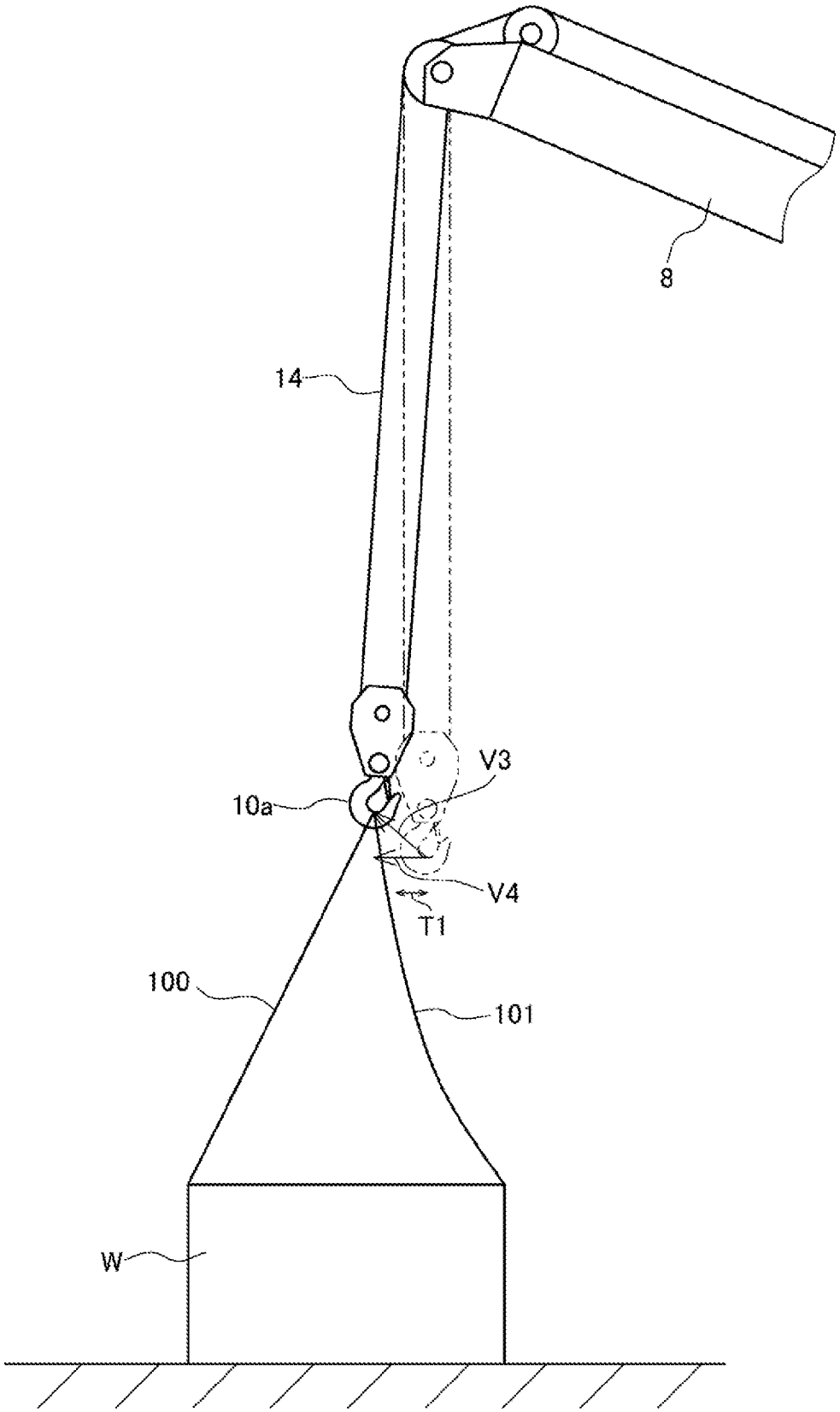
FIG. 7 illustrates the operation of the crane following that of FIG. 6.

Then, the same operations as those of FIGS. 4 to 6 are repeated. That is, in the state of FIG. 6, crane 1 rotates main winch 13 in the pulling-in direction to pull in main wire rope 14. As illustrated in FIG. 7, when main wire rope 14 comes to be in the tensioned state, main winch 13 is stopped. At this time, sling wire rope 100 is in the tensioned state and sling wire rope 101 remains in the relaxed state.

Figure 8:
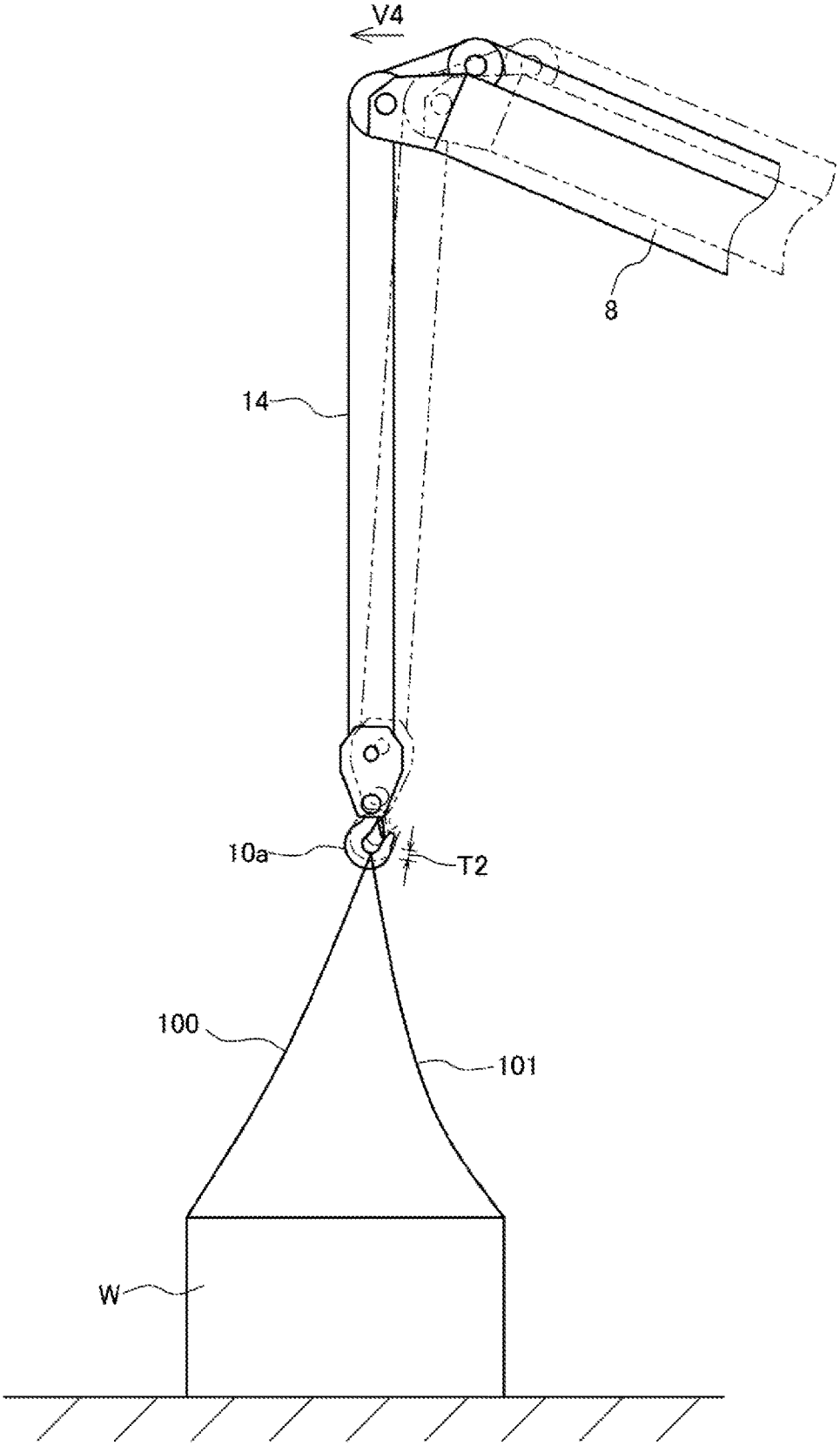
FIG. 8 illustrates the operation of the crane following that of FIG. 7.

Next, crane 1 computes movement direction and movement amount V3 of main hook 10*a* moved during transition of from the state of FIG. 6 to the state of FIG. 7, and computes horizontal component V4 of movement direction and movement amount V3. Then, after determining that horizontal component V4 is greater than or equal to first movement amount T1, crane 1 moves the leading end of telescopic boom 8 by the same amount in the same direction as horizontal component V4 as illustrated in FIG. 8. Accordingly, main hook 10*a* is lowered, sling wire rope 100 is relaxed, and main wire rope 14 is bought into the relaxed state.

Figure 9:
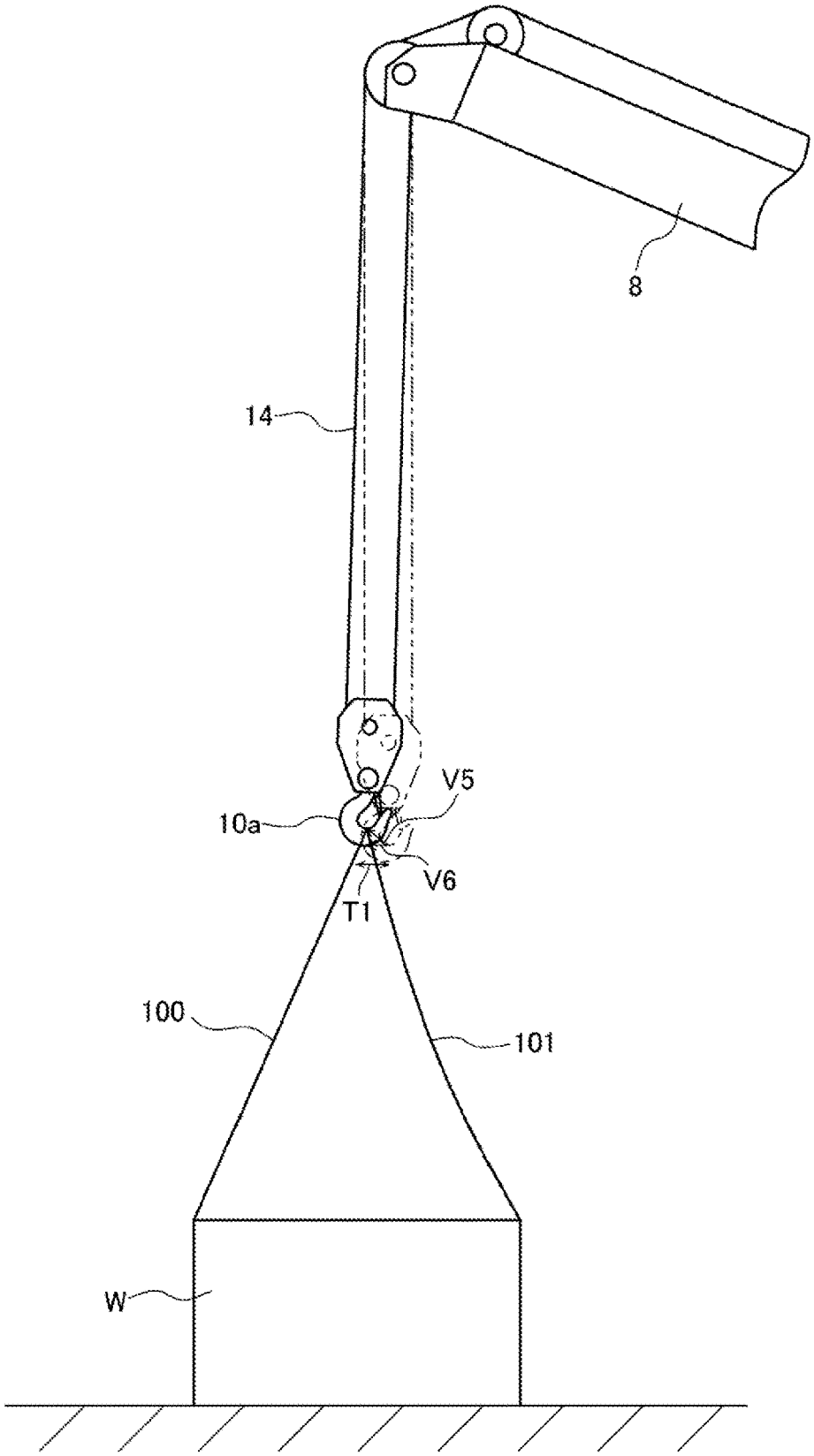
FIG. 9 illustrates the operation of the crane following that of FIG. 8.

Next, in the state of FIG. 8, crane 1 rotates main winch 13 in the pulling-in direction to pull in main wire rope 14. As illustrated in FIG. 9, when main wire rope 14 comes to be in the tensioned state, main winch 13 is stopped. At this time, sling wire rope 100 is in the tensioned state and sling wire rope 101 comes to be in the relaxed state near the tensioned state.

Next, crane 1 computes movement direction and movement amount V5 of main hook 10*a* moved during transition of from the state of FIG. 8 to the state of FIG. 9, and computes horizontal component V6 of movement direction and movement amount V5. Then, after determining that horizontal component V6 is less than first movement amount T1, crane 1 ends the hook position adjustment control. After this control, it becomes possible to lift load W substantially vertically with respect to its center-of-gravity position at the time of lift-off, so as to prevent the occurrences of side pulling and/or a swing of load W.

Figure 10:
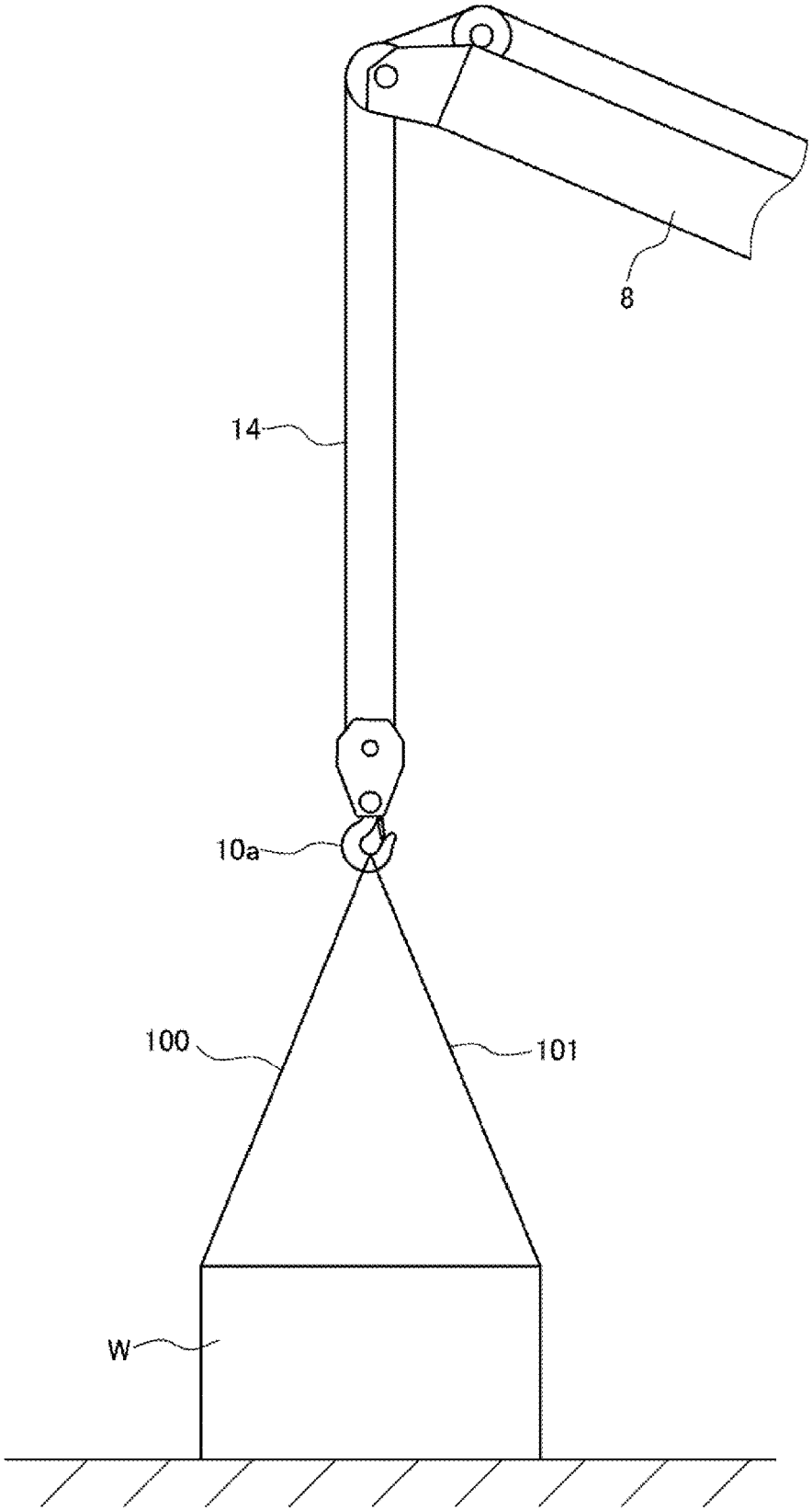
FIG. 10 illustrates a state of an ideal end of the hook position adjustment control according to one example of Embodiment 1.

FIG. 10 illustrates a state of an ideal end of the hook position adjustment control. In FIG. 10, main hook 10*a* is located at a position where all sling wire ropes 100 and 101 are in the tensioned state. It is possible to increase the accuracy of the hook position adjustment control to achieve a state close to the state of FIG. 10 by setting smaller first movement amount T1.

Embodiment 2

Figure 11:
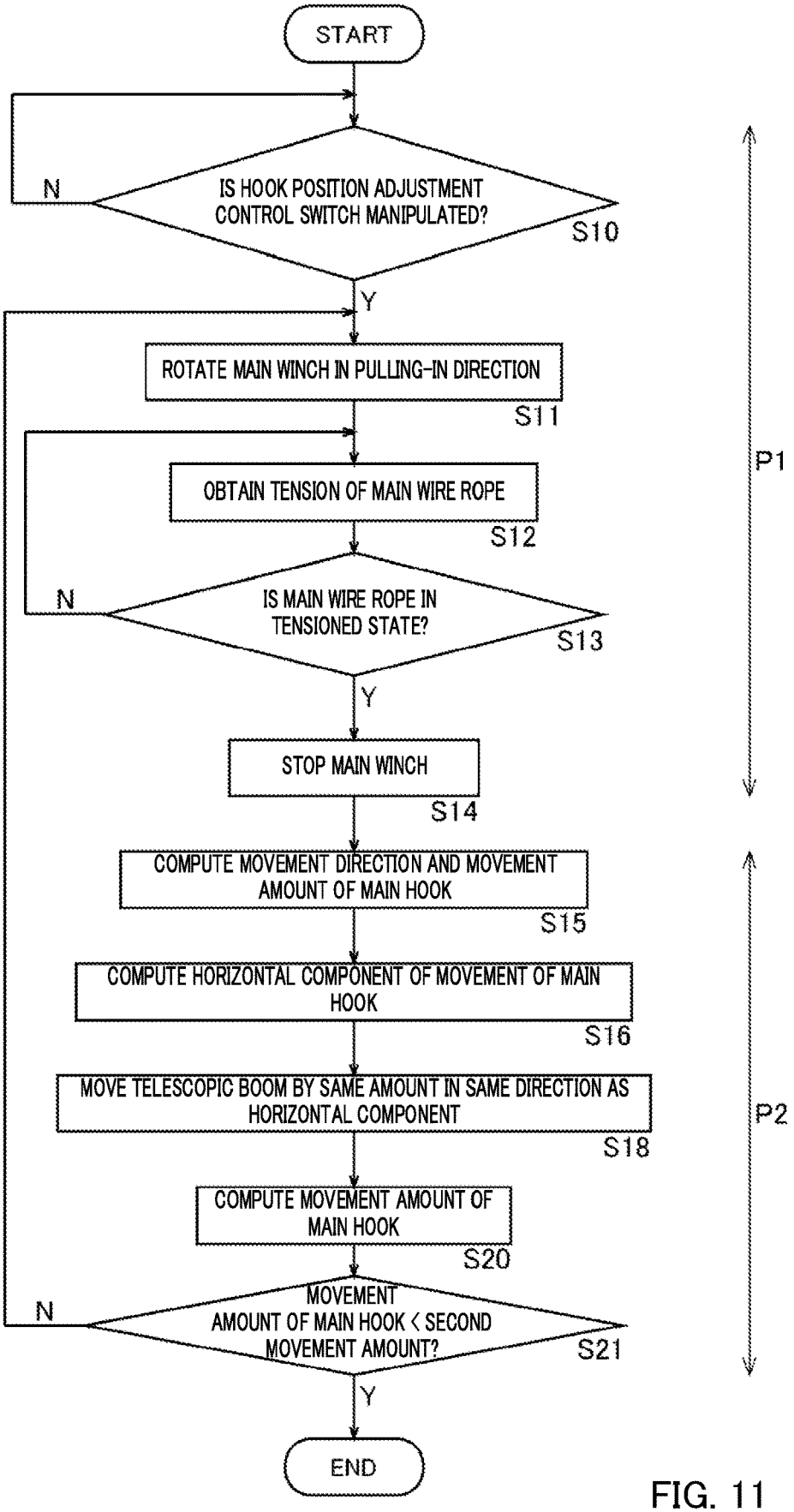
FIG. 11 is a flowchart illustrating an operation of the crane related to a hook position adjustment control according to Embodiment 2.

FIG. 11 is a flowchart illustrating the operation of crane 1 related to a hook position adjustment control according to Embodiment 2. Embodiment 2 is different from Embodiment 1 in the timing and conditions for judging the end of the hook position adjustment control, and the other operations are the same between Embodiments 1 and 2. That is, in FIG. 11, step S17 of FIG. 3 is removed, and step S20 and step S21 are provided following step S18. Steps S20 and S21 are included in the second process.

At step S20, computation section 20*c* analyzes an image captured by camera 17 and computes the movement amount of main hook 10*a* moved at step S18. Control device 20 proceeds from step S20 to step S21 at which determination section 20*d* determines whether or not the movement amount of main hook 10*a* computed at step S20 is less than second movement amount T2 (see FIG. 6). When it is determined at step S21 that the movement amount is less than second movement amount T2, control device 20 ends the hook position adjustment control. After this control, it becomes possible to lift load W substantially vertically with respect to its center-of-gravity position at the time of lift-off, so as to prevent the occurrences of side pulling and/or a swing of load W. Meanwhile, when it is determined at step S21 that the movement amount is greater than or equal to second movement amount T2, control device 20 returns to step S11.

Second movement amount T2 may be a value corresponding to little movement of main hook 10*a* at step S18. This indicates that main hook 10*a* is located at a position where all sling wire ropes 100 and 101 are substantially in the tensioned state on the occasion of lift-off. It is possible to bring main hook 10*a* closer to a more appropriate position by setting smaller second movement amount T2.

Embodiment 3

Figure 12:
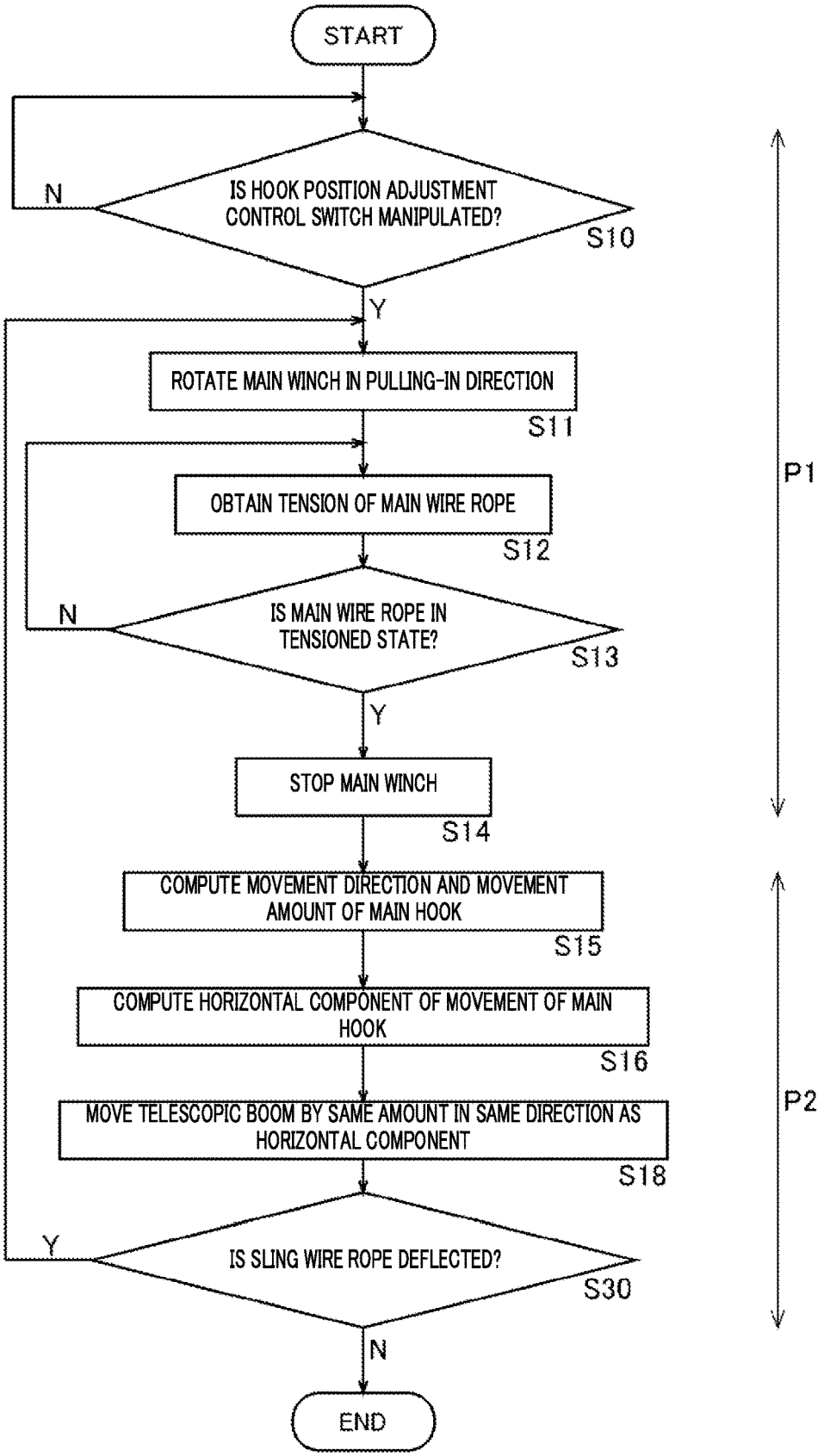
FIG. 12 is a flowchart illustrating an operation of the crane related to a hook position adjustment control according to Embodiment 3.

FIG. 12 is a flowchart illustrating the operation of crane 1 related to a hook position adjustment control according to Embodiment 3. Embodiment 3 is different from Embodiment 1 in the timing and conditions for judging the end of the hook position adjustment control, and the other operations are the same between Embodiments 1 and 3. That is, in FIG. 12, step S17 of FIG. 3 is removed, and step S30 is provided following step S18. Step S30 is included in the second process.

At step S30, determination section 20*d* determines based on an image captured by camera 17 whether or not sling wire ropes 100 and 101 are deflected. When it is determined at step S30 that none of sling wire ropes 100 and 101 is deflected, control device 20 ends the hook position adjustment control. After this control, it becomes possible to lift load W substantially vertically with respect to its center-of-gravity position at the time of lift-off, so as to prevent the occurrences of side pulling and/or a swing of load W. Meanwhile, when it is determined at step S30 that sling wire rope 100 or 101 is deflected, control device 20 returns to step S11.

Embodiment 4

Figure 13:
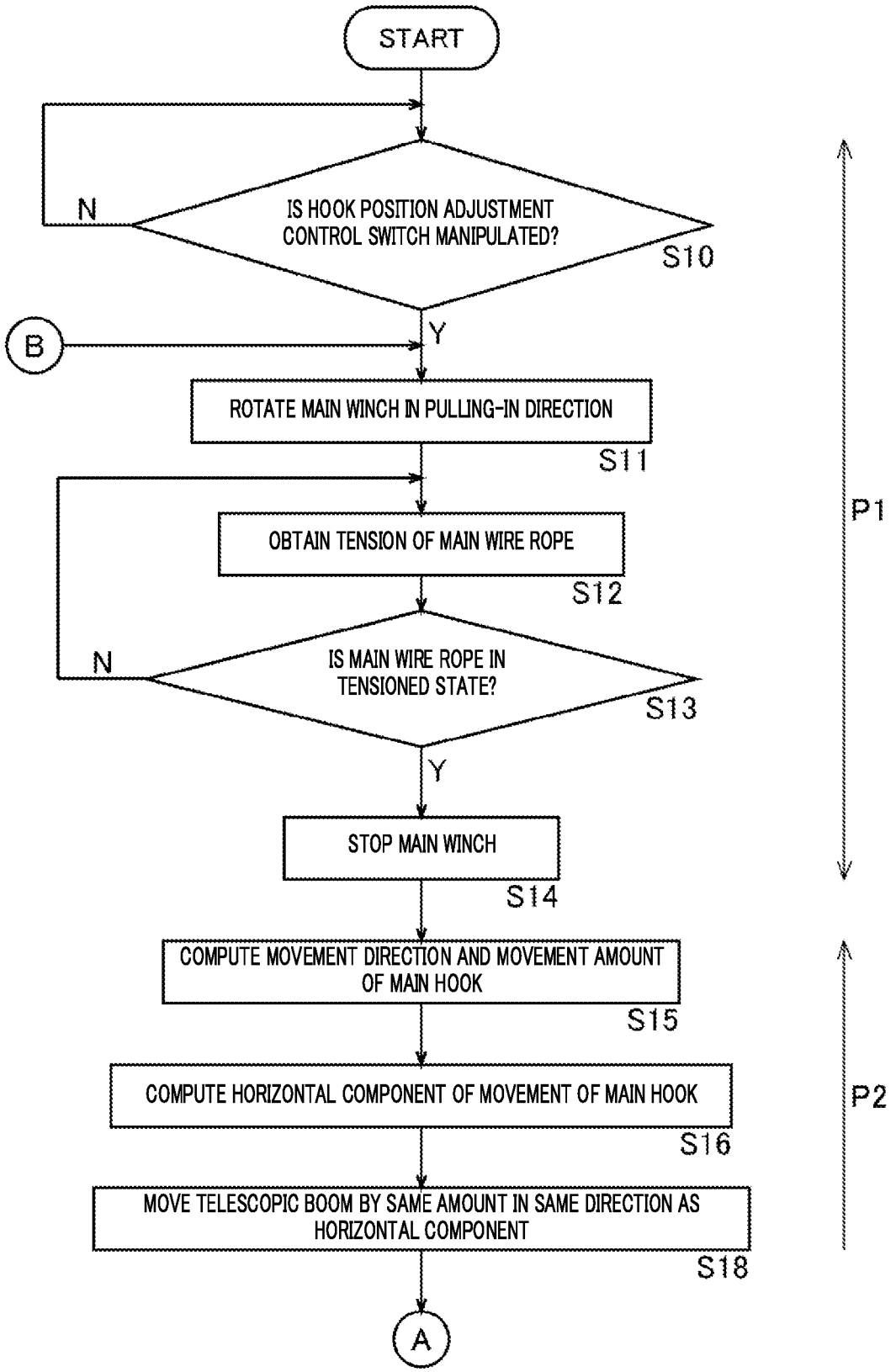
FIG. 13 is a flowchart illustrating an operation of the crane related to a hook position adjustment control according to Embodiment 4.
Figure 14:
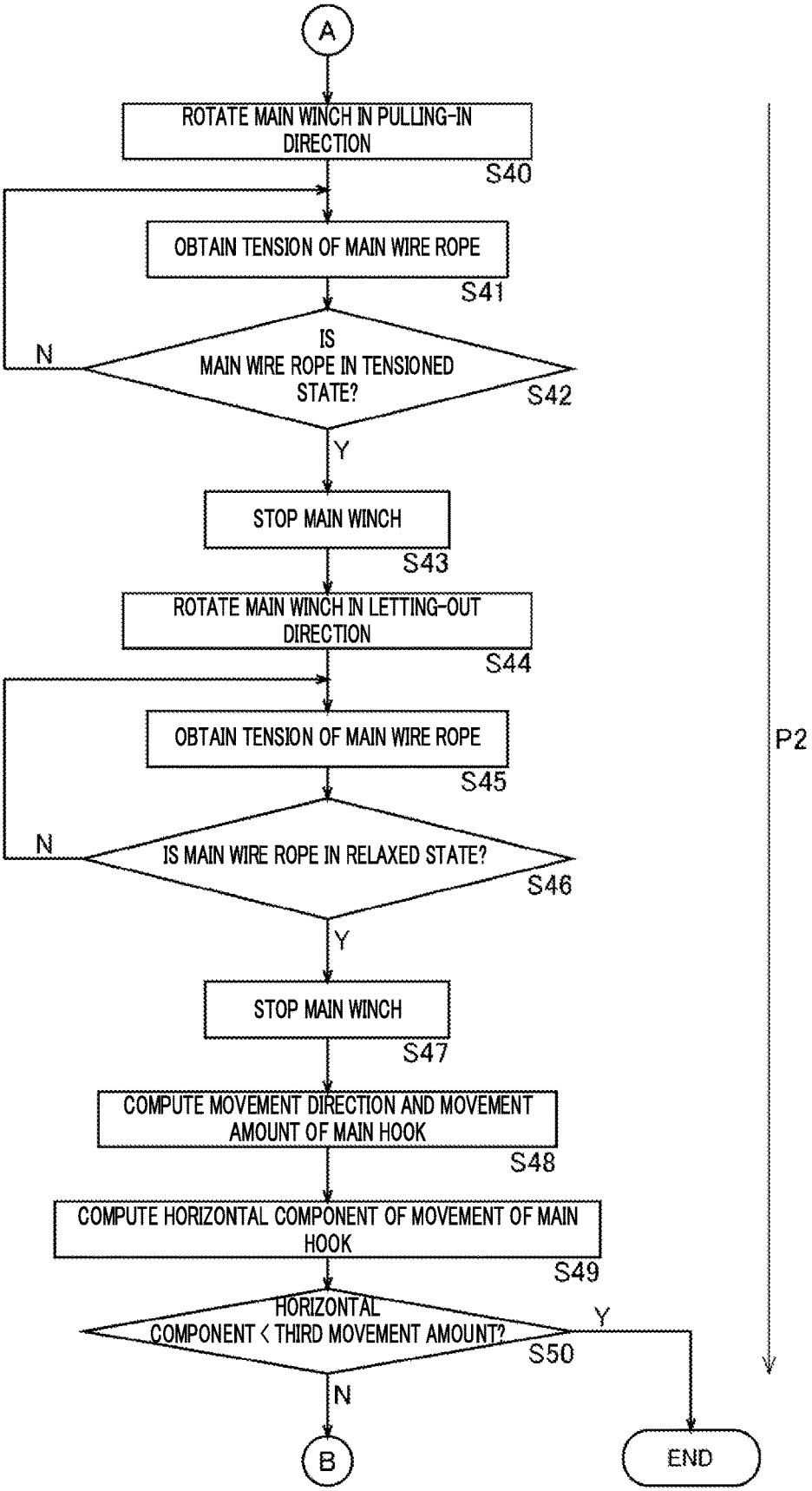
FIG. 14 is a flowchart following FIG. 13.

FIGS. 13 and 14 are flowcharts illustrating the operation of crane 1 related to a hook position adjustment control according to Embodiment 4. FIGS. 13 and 14 are connected to each other by parts A and B. Embodiment 4 is different from Embodiment 1 in the timing and conditions for judging the end of the hook position adjustment control, and the other operations are the same between Embodiments 1 and 4. That is, in FIG. 13, step S17 of FIG. 3 is removed, and steps S40 to S50 are provided following step S18. Steps S40 to S50 are included in the second process.

At step S40, output section 20*e* outputs to main winch 13 a signal for rotation in the pulling-in direction. Main wire rope 14 is thus pulled in. Subsequently, control device 20 proceeds to step S41 at which obtainment section 20*a* obtains a detection value from main-wire tension detector 25. Then, control device 20 proceeds to step S42 at which determination section 20*d* determines whether main wire rope 14 is in the tensioned or relaxed state.

When main wire rope 14 is determined to be in the relaxed state at step S42, control device 20 returns to step S41. Thereafter, when main wire rope 14 is changed from the relaxed state to the tensioned state at step S42, control device 20 proceeds from step S42 to step S43 at which output section 20*e* outputs a signal to stop revolution to main winch 13. Main winch 13 is thus stopped.

Next, control device 20 proceeds to step S44 at which output section 20*e* outputs to main winch 13 a signal for rotation in the letting-out direction. Main wire rope 14 is thus let out. Subsequently, control device 20 proceeds to step S45 at which obtainment section 20*a* obtains a detection value from main-wire tension detector 25. Then, control device 20 proceeds to step S46 at which determination section 20*d* determines whether main wire rope 14 is in the tensioned or relaxed state.

When main wire rope 14 is determined to be in the tensioned state at step S46, control device 20 returns to step S45. Thereafter, when main wire rope 14 is changed from the tensioned state to the relaxed state at step S46, control device 20 proceeds from step S46 to step S47 at which output section 20*e* outputs a signal to stop revolution to main winch 13. Main winch 13 is thus stopped.

In relation to the operations of from step S40 to step S47 as collectively regarded, such operations may be said to be a control by control device 20 to pull in main wire rope 14 to a position where main wire rope 14 is tensioned, and then let out main wire rope 14 to a position where main wire rope 14 is relaxed.

Figure 15:
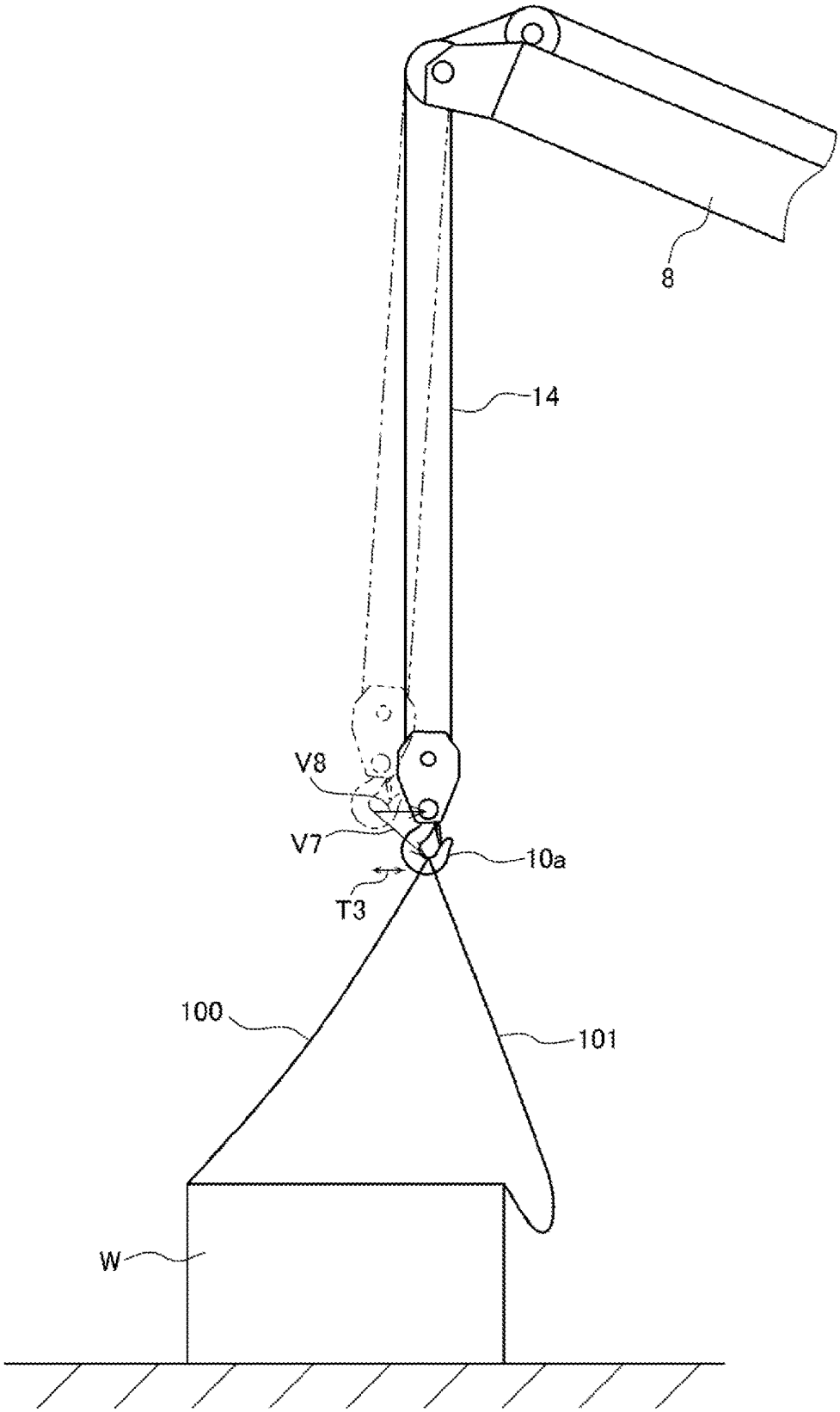
FIG. 15 illustrates a part of the operation of the crane according to Embodiment 4.

FIG. 15 illustrates one example of the operations of crane 1 of from step S48 to step S50. Control device 20 proceeds from step S47 to step S48 at which computation section 20*c* analyzes an image captured by camera 17, and computes movement direction and movement amount V7 of movement of main hook 10*a* in the control of letting out main wire rope 14 at steps S44 to S47. Subsequently, control device 20 proceeds to step S49 at which computation section 20*c* computes horizontal component V8 from movement direction and movement amount V7 of main hook 10*a*.

Subsequently, control device 20 proceeds to step S50 at which determination section 20*d* determines whether or not horizontal component V8 computed at step S49 is less than third movement amount T3. When it is determined at step S50 that horizontal component V8 is less than third movement amount T3, control device 20 ends the hook position adjustment control. After this control, it becomes possible to lift load W substantially vertically with respect to its center-of-gravity position at the time of lift-off, so as to prevent the occurrences of side pulling and/or a swing of load W. Meanwhile, when it is determined at step S50 that horizontal component V8 is greater than or equal to third movement amount T3, control device 20 returns to step S11.

Third movement amount T3 may be a value corresponding to little movement of main hook 10*a* between steps S44 and S47. This indicates that main hook 10*a* is located at a position where all sling wire ropes 100 and 101 are substantially in the tensioned state on the occasion of lift-off. It is possible to bring main hook 10*a* closer to a more appropriate position by setting smaller third movement amount T3.

Modification

In the above-described embodiments, the hook position adjustment control is performed when the hook position adjustment control switch is manipulated at step S10 of FIGS. 3 and 11 to 13, but alternatively, control device 20 may perform the hook position adjustment control automatically before lift-off after slinging. In this case, the state before lift-off after slinging can be determined based on an image captured by camera 17, for example.

In the above-described embodiments, the tension of main wire rope 14 is obtained at step S12 of FIGS. 3 and 11 to 13, and it is determined at step S13 based on the value of the tension whether main wire rope 14 is in the tensioned or relaxed state. However, alternatively, it may also be determined based on the image captured by camera 17 whether sling wire ropes 100 and 101 are in the relaxed or tensioned state.

Additionally or alternatively, the process of step S30 of FIG. 12 may be the same as those of steps S12 and S13. That is, the process of step S30 of FIG. 12 may be a process in which obtainment section 20*a* obtains a detection value from main-wire tension detector 25 and determination section 20*d* determines whether main wire rope 14 is in the tensioned or relaxed state.

The program related to the hook position adjustment control executed by control device 20 may be stored in a recording medium. In this case, a recording-medium reading device connected to control device 20 allows control device 20 to read the program from the recording medium to execute it. Additionally or alternatively, control device 20 may store in storage section 20*b* the program read from the recording medium, and may read the program from storage section 20*b* to execute it.

The program related to the hook position adjustment control executed by control device 20 may also be stored in a server apparatus. In this case, a communication section connected to control device 20 allows control device 20 to receive the program from the server apparatus to execute it. Additionally or alternatively, control device 20 may store in storage section 20*b* the program received from the server apparatus, and may read the program from storage section 20*b* to execute it.

In the above-described embodiments, the image captured by camera 17 is used to detect the states of main wire rope 14, main hook block 10, sling wire ropes 100 and 101, and load W. However, an Inertial Measurement Unit (IMU), a wire swing angle sensor, or the like may also be used instead of camera 17.

While the above-described embodiments have been described in relation to an example of load W suspended on main hook 10*a*, the present invention is also applicable to a load suspended on sub hook 11*a* or to a load suspended on sub hook 11*a* using jib 9.

INDUSTRIAL APPLICABILITY

The present invention can be utilized for a control for cranes performed before lift-off.

REFERENCE SIGNS LIST

1 Crane
7 Swivel base
8 Telescopic boom
9 Jib
10*a* Main hook (Hook)
11*a* Sub hook (Hook)
14 Main wire rope (Wire rope)
16 Sub wire rope (Wire rope)
20 Control device
100, 101 Sling wire rope
P1 First process
P2 Second process
T1 First movement amount
T2 Second movement amount
T3 Third movement amount
V2, V4, V6 Horizontal component
W Load

The invention claimed is:

1. A method of controlling a working machine that raises or lowers a load using a plurality of sling wires suspended by a hook at an end of a wire rope suspended on a telescopic boom or jib, detects a tension of the wire rope using a detection section, and determines plane coordinates of the hook from an image capturing in a vertically-downward direction at predetermined intervals by a camera provided on the leading end of the telescopic boom or the leading end of the jib, the method comprising:

pulling in the wire rope until determining that the wire rope has reached a tensioned state in a state where the load is suspended by the plurality of sling wires, and before lift-off of the load;

moving a leading end of the telescopic boom or jib to same plane coordinates as those of the hook at a time of determining the tensioned state, wherein the plane coordinates are calculated by analyzing the image captured by the camera; and repeating the determining and the moving.

2. A working machine that raises or lowers a load using a plurality of sling wires suspended by a hook at an end of a wire rope suspended on a telescopic boom or jib, the working machine comprising:

a detection section that detects a tension of the wire rope;

a camera provided on the leading end of the telescopic boom or the leading end of the jib and capturing an image in a vertically-downward direction at predetermined intervals to determine plane coordinates of the hook; and a control section that pulls in the wire rope until determining that the wire rope has reached a tensioned state based on a detection value from the detection section in a state where the load is suspended by the plurality of sling wires and before lift-off of the load, and moves a leading end of the telescopic boom or jib to same plane coordinates as those of the hook at a time of determining the tensioned state, wherein the plane coordinates are calculated by analyzing the image captured by the camera, wherein the control section repeats the determining and the moving.

3. The working machine according to claim 2, wherein, when a horizontal component of a movement amount of the hook at a time when the wire rope reaches the tensioned state is less than a first movement amount, the repeating is ended without the moving of the leading end of the telescopic boom or jib.

4. The working machine according to claim 2, wherein the repeating is ended when a movement amount the hook has moved when the leading end of the telescopic boom or jib is moved is less than a second movement amount.

5. The working machine according to claim 2, wherein the repeating is ended when the plurality of sling wires is not deflected after the leading end of the telescopic boom or jib is moved.

6. The working machine according to claim 2, wherein the control section controls the wire rope such that the wire rope is changed from the tensioned state to a relaxed state after the leading end of the telescopic boom or jib is moved, and ends the repeating when a horizontal movement amount of the hook during such control is less than a third movement amount.

7. The working machine according to claim 6, wherein the tensioned state of the wire rope is a state in which the tension of the wire rope is equal to or greater than a predetermined value, and the relaxed state of the wire rope is a state in which the tension of the wire rope is less than a predetermined value.

* * * * *